US007900550B2

(12) United States Patent
Lætgaard

(10) Patent No.: US 7,900,550 B2
(45) Date of Patent: Mar. 8, 2011

(54) COMPRESSION CHAMBER UNIT AND A METHOD FOR FORMING SUCH UNIT

(75) Inventor: Thomas Lætgaard, Horsens (DK)

(73) Assignee: Active Tools International (HK) Ltd., Hong Kong (HK)

( * ) Notice: Subject to any disclaimer, the term of this patent is extended or adjusted under 35 U.S.C. 154(b) by 911 days.

(21) Appl. No.: 11/793,931

(22) PCT Filed: Dec. 22, 2005

(86) PCT No.: PCT/DK2005/000823

§ 371 (c)(1),
(2), (4) Date: Jul. 6, 2007

(87) PCT Pub. No.: WO2006/066597

PCT Pub. Date: Jun. 29, 2006

(65) Prior Publication Data

US 2008/0050227 A1 Feb. 28, 2008

(30) Foreign Application Priority Data

Dec. 22, 2004 (DK) ..... 2004 01971

(51) Int. Cl.
*F04B 35/04* (2006.01)
*B60S 5/04* (2006.01)

(52) U.S. Cl. ..... 92/169.1; 92/171.1

(58) Field of Classification Search ..... 92/169.1, 92/164, 144, 169.2, 171.1; 417/550; 29/888.02
See application file for complete search history.

(56) References Cited

U.S. PATENT DOCUMENTS 6,783,333 B2 * 8/2004 Wang ..... 417/550

FOREIGN PATENT DOCUMENTS

| | | |
|---|---|---|
| GB | 2039620 | 8/1980 |
| GB | 2277966 | 11/1999 |
| WO | WO 02/057630 | 7/2002 |

* cited by examiner

*Primary Examiner* — Thomas E Lazo
(74) *Attorney, Agent, or Firm* — James Creighton Wray

(57) ABSTRACT

The present invention relates to a compression chamber unit (1) of an air pump, comprising a cylindrical body part (3) provided with at least one outlet nozzle (4), a number of connecting flanges (6) and a number of connecting bosses (7), wherein the cylindrical body part (3) is an extruded cylinder and a cap (2) is formed with outlet nozzle (4), connecting flanges (6) and connecting bosses (7), where the cap (2) is adapted to engage with a first end part (10) of the cylindrical body part (3). The present invention further more relates to a method for forming a compression chamber unit (1) which method comprises the following steps:

the cylindrical body part (3) is extruded, and the cap (2) is moulded onto the cylindrical body part (3).

10 Claims, 3 Drawing Sheets

COMPRESSION CHAMBER UNIT AND A METHOD FOR FORMING SUCH UNIT

This application claims the benefit of Danish Application No. PA 2004 01971 filed Dec. 22, 2004 and PCT/DK2005/000823 filed Dec. 22, 2005, which are hereby incorporated by reference in their entirety.

FIELD OF THE INVENTION

The present invention relates to a compression chamber unit of an air pump, comprising a cylindrical body part, said unit is provided with at least one outlet nozzle, a number of connecting flanges and a number of connecting bosses, wherein the unit comprises a cap which is formed with an outlet nozzle.

Furthermore, the present invention relates to a method for forming a compression chamber unit.

BACKGROUND OF THE INVENTION

To produce pressurized air with an air pump, the air pump is provided with a compression chamber unit wherein the air is being compressed.

An air pump, e.g. for pumping air into a deflated tire, must quickly pump a certain amount of air at a certain pressure.

Previously, the applicant formed the compression chamber unit by die casting of the whole compression chamber unit in one process. Hence, the compression chamber unit was one unit with at least one outlet nozzle, a number of connecting flanges and a number of connecting bosses.

The above method is in some ways disadvantageous, as the die casting process lacks accuracy as regards the forming of a number of compression chamber units of the same volume, the right cylindrical form and with a smooth surface. Hence, additional processes must be carried out.

E.g. for reducing friction the surface must be smooth, thus it requires polishing, and it is necessary to roll the compression chamber units to provide the right cylindrical form and specific volume. Hence, friction reduction causes a reduction in the compression chamber unit heat development.

Furthermore, the die casting process is disadvantageous because of suction in the material, hence making the distribution of the material uneven, thereby reducing the number of usable compression chamber units.

Another disadvantage is that the die casting process requires a slip angle of the die cast compression chamber unit in order to remove the compression chamber unit from the cast.

Others have tried to solve this problem by using a cylindrical body part with a cap. However, this is disadvantageous as it requires a sealing ring for ensuring an air-tight compression chamber unit.

Due to the temperature difference which is caused by the compression of air or by movement of the air pump between different environments, the thickness of the sealing ring differs, and the volume of the compression chamber unit changes, hence making it difficult to calculate the specific compression chamber unit volume.

Furthermore, wear and tear of the sealing ring significantly increases the risk of the non-air-tight compression chamber unit becoming defect.

OBJECT OF THE INVENTION

Thus the objective of the present invention is to provide easily produced compression chamber units of the same volume without sealing rings.

According to the present invention, this is achieved with a unit of the kind mentioned in the preamble claim 1, where the cylindrical body part is an extruded cylinder and a cap is formed with outlet nozzle, connecting flanges and connecting bosses, where the cap is adapted to engage with a first end part of the cylindrical body part.

A further objective of the present invention is to provide a method for producing a compression chamber unit.

According to the present invention, this objective is achieved with a method comprising the following steps:

the cylindrical body part is extruded, and the cap is moulded onto the cylindrical body part

DESCRIPTION OF THE INVENTION

The invention relates to a compression chamber unit which is peculiar in that the cylindrical body comprises an extruded cylinder, that the cap is connected with the connecting flanges via longitudinal parts which covers only part of the extruded cylinder and that the cap is adapted to engage with a first end part of the cylindrical body part whereas the connecting flanges are provide at a second end part of the cylindrical body part. The connecting flanges are used for arranging the compression chamber unit of the air pump, and the connecting bosses are used for connecting e.g. an air valve. The four connecting flanges are connected to the cap with longitudinal parts, which covers only part of the cylindrical body part, hence allowing heat dissipation from the exposed parts of the cylindrical body part. Finally, the outlet nozzle is used for letting compressed air out of the compression chamber unit.

The cylindrical body part is an extruded cylinder. By extruding the cylindrical body part it is possible to provide the cylindrical body parts with optimum cylindrical form and identical diameter, hence it is possible to produce compression chamber units of identical volume. This reduces the amount of discarded compression chamber units not complying with the requirements as regards a specific diameter/volume.

Furthermore, it is possible to extrude the cylindrical body parts with a very smooth surface, which requires little polishing or no polishing at all. The smoothness of the cylindrical body part surface is important as regards air resistance. A smooth surface results in low friction and thus low energy consumption for providing the necessary amount of compressed air.

According to one embodiment of the present invention a cap is formed with outlet nozzle, connecting flanges and connecting bosses. The cap is a separate unit, which is adapted to engage with a first end part of the cylindrical body part. Hence, it is possible to mount the compression chamber unit at one end of the air pump and at the other end close the compression chamber unit with the cap, making it possible to compress air.

To ensure air-tight arrangement of the cap to the cylindrical body part of the compression chamber unit, the cylindrical body part is provided with an encircling recess at the first end part arranged for engaging with an encircling protrusion of the cap, and the cap is provided with an encircling recess for engaging with the first end part.

The engagement of the cylindrical body part recess and the encircling protrusion of the cap along with the engagement of the cap recess and the first end part of the cylindrical body part makes it impossible for air to escape through the connection between the cylindrical body and the cap, as the air is pressed around both connections of the cylindrical body part recess and the encircling protrusion of the cap and the recess in the cap and the first end part of the cylindrical body part.

Furthermore, the recesses cause the cap to be connected to the cylindrical body part in a safe and non-removable manner. Hence, every compression chamber unit is identical.

During the compression of air the compression chamber unit is heated. To avoid over-heating of the compression chamber unit, the cylindrical body part is provided with a number of ribs on the outside causing the accumulated heat to dissipate to the inside environment of the air pump.

According to one embodiment of the invention the air pump is provided with a fan causing air to move past the compression chamber unit, and the amount of heat dissipated from the compression chamber unit due to the ribs increases, and the air pump does not become overheated.

The ribs are cooling ribs and can be provided as longitudinal ribs or as encircling ribs around an outer surface of the cylindrical body part. If the cylindrical body part is provided with longitudinal ribs, it is possible to extrude the cylindrical body part with the ribs. The size and the number of ribs necessary to dissipate heat from the compression chamber unit depend on the air pump effect.

Due to the heat caused by the compression of air and the passing of compressed air, the nozzle outlet area is very warm, and according to an embodiment of the present invention the cap is provided with a nozzle connector, which is arranged in connection with the nozzle outlet. The nozzle connector is formed of a heat-resistant material making it able to withstand high temperatures; hence the risk of damaging the nozzle outlet area and blocking of the compression chamber unit is reduced.

According to one embodiment of the present invention the connecting flanges are arranged at a second end part of the cylindrical body part. Hence, the compression chamber unit can be connected to the air pump by means of short stags through the connecting flanges.

The connecting flanges are an integrated part of the cap, however, in order to prevent the connecting flanges from covering the ribs and consequently preventing necessary heat dissipation, the connecting flanges are provided with longitudinal parts, which run along the outer side of the cylindrical body part to an end part of the cap.

Alternatively, the connecting flanges are arranged at or near the end part of the cap. Hence, it is necessary to use long stags for connecting the compression chamber unit to the air pump. This way a large area of the ribs is exposed, thus the heat dissipation from the compression chamber unit increases.

According to a preferred embodiment of the present invention the cylindrical body part is extruded from aluminium, making it possible to extrude the cylindrical body part with or without the rib, while at the same time the cylindrical body part surface is smooth and the form cylindrical.

As an alternative to aluminium, other metals, hard plastic or combinations of such materials can be applied. However, the materials must be heat-resistant and must be extruded with a smooth surface.

According to a preferred embodiment of the present invention the cap is moulded from plastic, which is heat-resistant and preferably hard, making it possible to attach a valve with e.g. a screw to the connecting bosses and to attach the compression chamber unit to the air pump by means of stags.

An alternative to plastic is metals, ceramics or combinations of such materials. However, the materials must be heat-resistant and must be connected to the cylindrical body part. E.g. the cap can be die cast.

The method of forming a compression chamber unit comprises the following steps:

the cylindrical body part is extruded, and the cap is moulded onto the cylindrical body part.

Firstly, a cylindrical body part is extruded with or without ribs. Secondly, the cap is moulded onto the cylindrical body part. A cap is also called an over moulding, as the cap is formed and connected to the cylindrical body part in one moulding process.

The moulding of the cap onto the cylindrical body part along with the engagement of the recess and encircling protrusion and the recess and the end part of the cylindrical body part cause the cap to be air-tight mounted onto the cylindrical body part.

Furthermore, the method comprises the step of providing the nozzle connector in connection with the nozzle outlet, where the nozzle connector is moulded into the nozzle outlet during the moulding of the cap onto the cylindrical body part.

DESCRIPTION OF THE DRAWINGS

In the following the invention is explained in more detail with reference to the accompanying drawing, where.

DETAILED DESCRIPTION OF THE INVENTION

Figure 1:
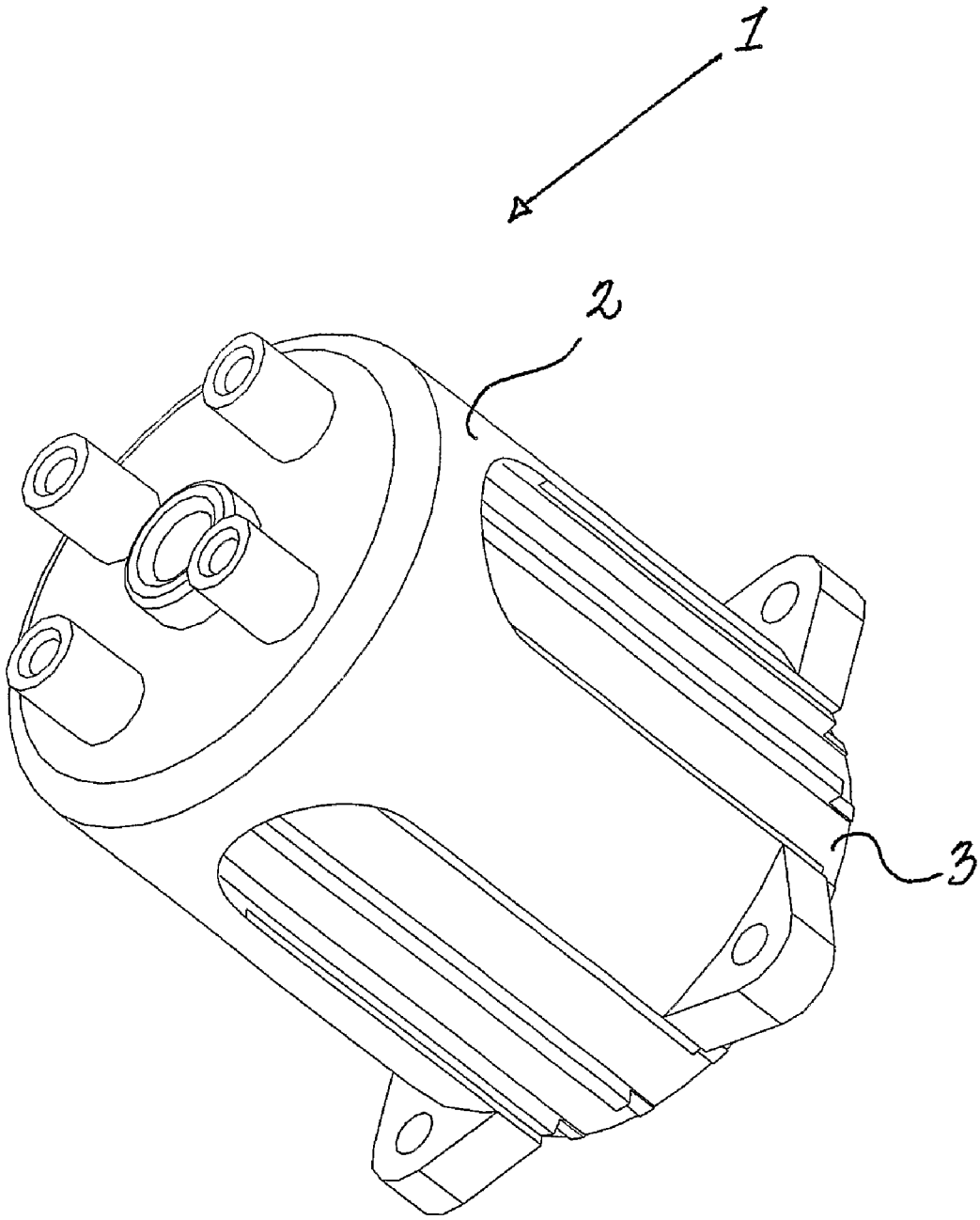
FIG. 1 shows a compression chamber unit according to the invention.

FIG. 1 shows a compression chamber unit 1 comprising a cap 2 and a cylindrical body part 3, where the cap 2 is moulded onto the cylindrical body part 3 making it close one end of the compression chamber unit 1 air-tight, while the other end of the compression chamber unit 1 is adapted for connection to the air pump (not shown).

Figure 2:
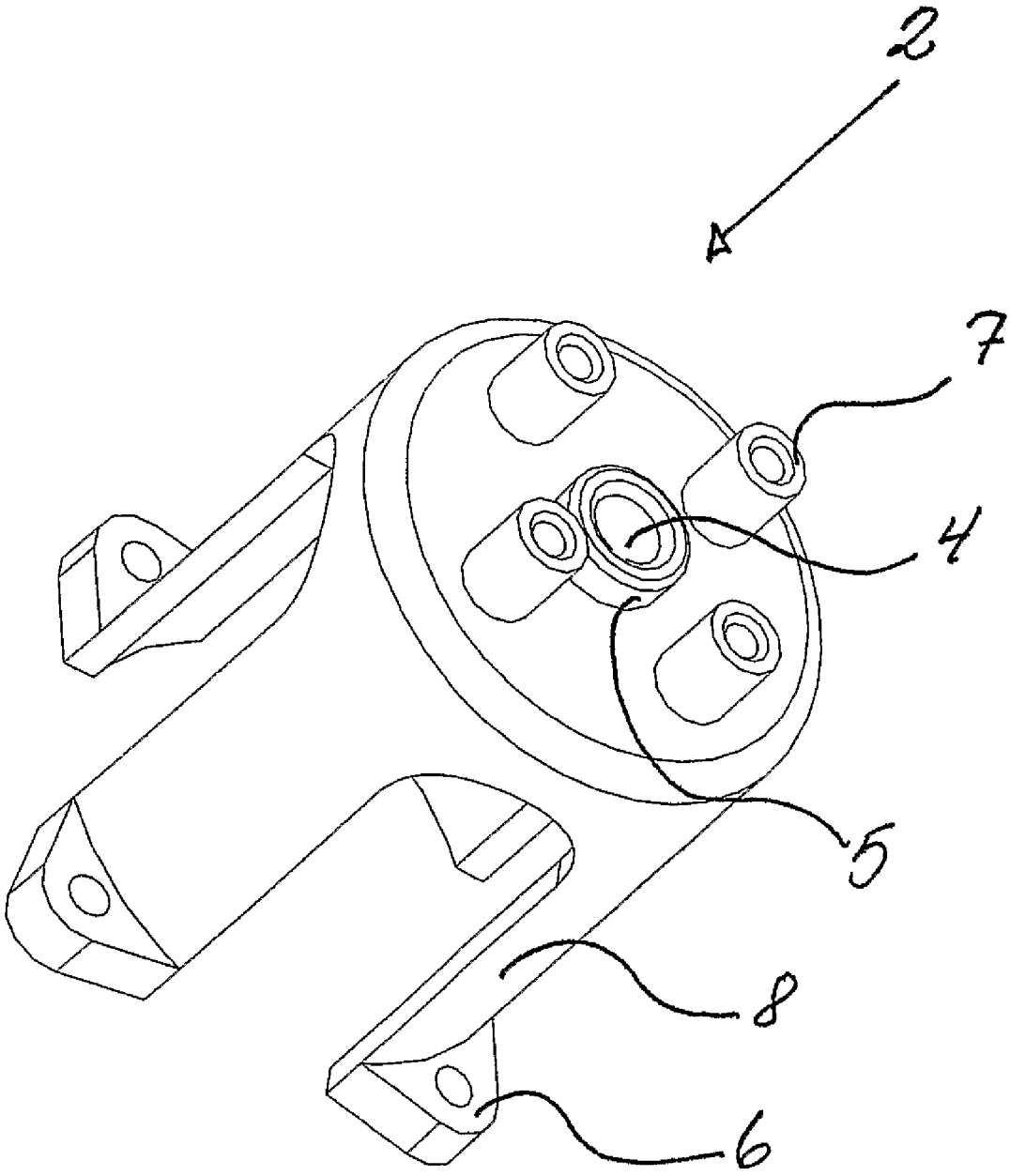
FIG. 2 shows a cap.

FIG. 2 shows a cap 2 comprising a central outlet nozzle 4, a nozzle connector 5, four connecting flanges 6 and four connecting bosses 7, where the nozzle connector 5 is connected to the central outlet nozzle 4. The four connecting bosses 7 are arranged around the central outlet nozzle 4 and adapted for receiving e.g. screws (not shown) for the attachment of e.g. a valve (not shown). The four connecting flanges 6 are connected to the cap 2 with longitudinal parts 8, which covers only part of the cylindrical body part (not shown), hence allowing heat dissipation from the exposed parts of the cylindrical body part (not shown).

Figure 3:
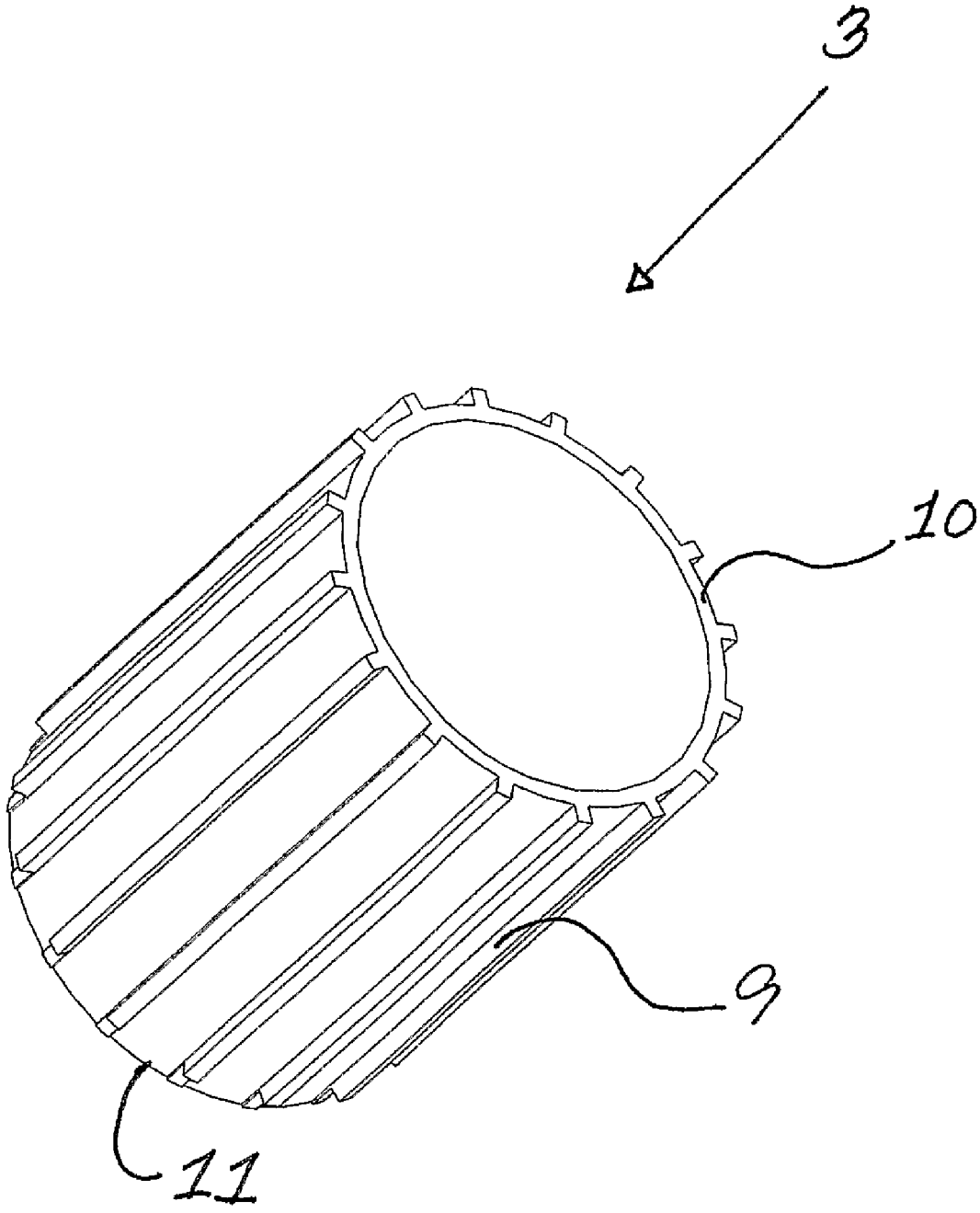
FIG. 3 shows a cylindrical body part.

FIG. 3 shows a preferably extruded cylindrical body part 3 with a number of longitudinal ribs 9, which are adapted for dissipating heat from the cylindrical body part 3 due to the compression of air. The upper edge 10 of the cylindrical body part 3 engages with a recess (not shown) in the cap, hence making the connection between the cap (not shown) and the cylindrical body part 3 airtight without using a sealing ring.

The invention claimed is:

1. Compression chamber unit of an air pump, comprising a cylindrical body part, said unit is provided with at least one outlet nozzle, a number of connecting flanges and a number of connecting bosses, wherein the unit comprises a cap which is formed with an outlet nozzle, wherein the cylindrical body comprises an extruded cylinder, that the cap is connected with the connecting flanges via longitudinal parts which covers only part of the extruded cylinder and wherein the cap is adapted to engage with a first end part of the cylindrical body part whereas the connecting flanges are provide at a second end part of the cylindrical body part.

2. Compression chamber unit according to claim 1, wherein the cylindrical body part is provided with an encircling recess at the first end part arranged for engaging with an encircling protrusion of the cap.

3. Compression chamber unit according to claim 1, wherein the cap furthermore is provided with an encircling recess for engaging with the first end part.

4. Compression chamber unit according to claim 1, wherein the cylindrical body part on an outside is provided with a number of ribs.

5. Compression chamber unit according to claim 1, wherein the cap is provided with a nozzle connector, which is arranged in connection with the nozzle outlet.

6. Compression chamber unit according to claim 1, wherein the connecting flanges are arranged at a second end part of the cylindrical body part.

7. Compression chamber unit according to claim 1, wherein the cylindrical body part is extruded from aluminium.

8. Compression chamber unit according to claim 1, wherein the cap is moulded from plastic.

9. Method for forming a compression chamber unit according to claim 1, wherein the method comprises the following steps:

the cylindrical body part is extruded, and the cap is moulded onto the cylindrical body part.

10. Method according to claim 9, wherein the method furthermore comprises the step of providing the nozzle connector in connection with the nozzle outlet.

* * * * *